United States Patent [19]

Chapell

[11] Patent Number: 4,755,778

[45] Date of Patent: Jul. 5, 1988

[54] MICROWAVE APPARATUS

[75] Inventor: Harry F. Chapell, Maynard, Mass.

[73] Assignee: Sage Laboratories, Inc., Natick, Mass.

[21] Appl. No.: 61,148

[22] Filed: Jun. 12, 1987

[51] Int. Cl.[4] ..... H01P 1/18

[52] U.S. Cl. ..... 333/159; 333/156; 333/160; 333/235

[58] Field of Search ..... 333/156–162, 333/207, 209, 248, 263, 235

[56] References Cited

U.S. PATENT DOCUMENTS 2,502,359 3/1950 Wheeler ..... 333/159

3,763,445 10/1973 Hannaford et al. ..... 333/160

*Primary Examiner*—Marvin L. Nussbaum

*Attorney, Agent, or Firm*—Wolf, Greenfield & Sacks

[57] ABSTRACT

An electromagnetic signaling apparatus, particularly in which components thereof have relative adjustment therebetween. A combination lead screw and associated support nut moves one of the components, such as may appear in a phase shifter. The lead screw has thread reliefs to provide disengagement at predetermined limits of rotation so as to prevent jamming and thread stripping. Spring means are employed for re-engagement.

8 Claims, 8 Drawing Sheets

MICROWAVE APPARATUS

BACKGROUND OF THE INVENTION

1. Field of the Invention

The present invention relates in general to electromagnetic signal apparatus and pertains, more particularly, to such an apparatus in which components thereof are relatively slideable. An example of such apparatus is a phase-shifter. Even more particularly, the invention relates to the foregoing apparatus in which means are provided for preventing jamming of and damage to the components during use and adjustment thereof.

2. Background Discussion

In microwave devices, particularly those requiring adjustment of components of the device, such as in a phase-shifter, many times jamming and damage to the device occurs when the user over-adjusts in one direction or the other. Such damage to phase-shifters has become a recurring problem. The damage to the phase-shifter has occurred primarily because the user applies excess torque to the lead screw at either end of the adjustment position. Even with caution being given to users to avoid over-torquing, damage to the phase-shifter is still quite common.

With regard to the aforementioned problem, reference is now made to FIG. 1 which is a prior art cross-sectional view illustrating a simplified version of a phase-shifter that includes a housing 10 having one end wall 11 and a wall 15 for supporting the lead screw 16. The housing 10 also is illustrated in FIG. 1 as supporting input signal connector 12 and output signal connector 14. These connectors couple to stationary conductors 12A and 14A, respectively. Associated with the stationary or fixed conductors is a moveable conductor 18 that is supported by the slider 20. The slider supports a nut 22 that is adapted to engage with the lead screw 16. Rotation of the lead screw 16 at the shaft 24 causes the slider 20 to move toward and away from the end wall 11.

FIG. 1 illustrates the phase-shifter in its maximum phase setting with the slider 20 fully to its left position. This position illustrates the aforementioned problem in that the slider 20 bottoms out at 25 against the end wall 11. The threads of the lead screw 16 can thus easily become stripped if too much torque is applied at the shaft 24. The same type of operation can also occur when the lead screw is rotated in the opposite direction by the shaft 24. In that instance the right most end of the slider 20 can bottom out against the wall 15 and also cause jamming, stripping of threads and damage to the phase-shifter.

OBJECTS OF THE INVENTION

Accordingly, it is an object of the present invention to provide an improved electromagnetic energy apparatus, such as a phase-shifter in which damage and jamming to the apparatus by over-torquing is prevented.

Another object of the present invention is to provide an improved microwave apparatus in which relative components thereof are adjusted through some predetermined range without causing damage to the apparatus.

A further object of the present invention is to provide, in particular, an improved phase-shifter in which a lead screw adjustment occurs without causing damage, jamming and thread stripping.

Still another object of the present invention is to provide an improved microwave apparatus as in accordance with the preceding objects and which can be designed quite simply, is maintenance free, and can be easily operated by relatively unskilled users without fear of damage.

SUMMARY OF THE INVENTION

To accomplish the foregoing and other objects, features and advantages of the invention there is provided an electromagnetic energy apparatus such as a phase-shifting apparatus that generally comprises a housing and signal conductor means in the housing including both fixed position signal conductor means and moveable position signal conductor means. Slide means are provided for supporting the moveable position signal conductor means and furthermore there is provided drive means for longitudinally displacing the slide means and in turn the moveable position signal conductor means to alter a particular parameter such as for alteration of phase-shift. The drive means includes an adjusting screw means and a nut means. The screw means and nut means are adapted to be positioned for relative engagement therebetween. A thread relief at at least one end of the adjusting screw means is provided to limit the longitudinal displacement of the slide means in both directions of translation thereof. First means are provided for urging the slide means in one direction at the end of one limit of engagement between the adjusting screw means and nut means. The first means permits re-engagement of the adjusting screw means and nut means. There is furthermore provided second means for urging the slide means in the opposite direction upon attaining the opposite limit between the adjusting screw means and the nut means to thus permit re-engagement of the adjusting screw means and nut means.

The adjusting screw means may have a thread relief means at opposite ends thereof and the first and second means recited above may each comprise spring means. The spring means may be disposed at opposite respective ends of the slide means.

Although, in accordance with the present invention, the preferred embodiment thereof is described as embodied in a phase-shifter, it is understood that the principles of the present invention may also be applied in association with other types of products, particularly those in which components thereof are adapted to be moveable relative to each other.

BRIEF DESCRIPTION OF THE DRAWINGS

Numerous other objects, features, and advantages of the invention should now become apparent upon a reading of the following detailed description taken in conjunction with the accompanying drawings, in which.

DETAILED DESCRIPTION

Figure 1:
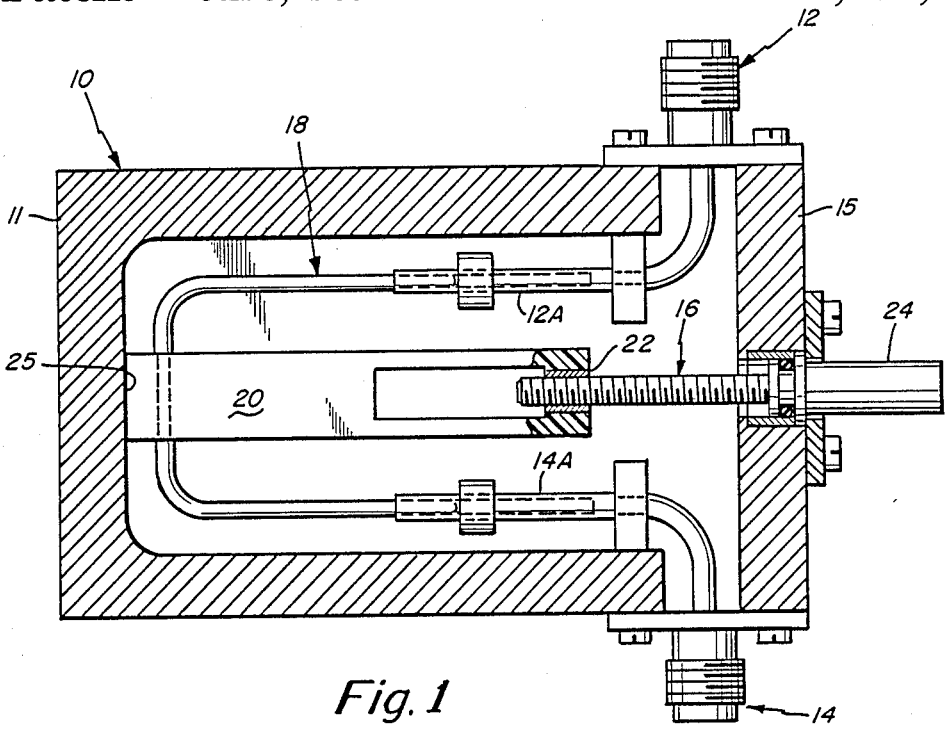
Fig. 1 (PRIOR ART)
FIG. 1 is a cross-sectional view of a prior art phase-shifter illustrating certain problems associated therewith.

Reference has been made hereinbefore to the prior art diagram of FIG. 1 for an illustration of the problem of jamming due to over-torquing at the shaft 24 on the lead screw 16. As referenced previously in FIG. 1, if the user operates the lead screw 16 in either direction with too much torque then the slider can bind against either end wall of the housing and cause jamming. This can cause a stripping of the threads between the lead screw 16 and the nut 22.

Figure 2:
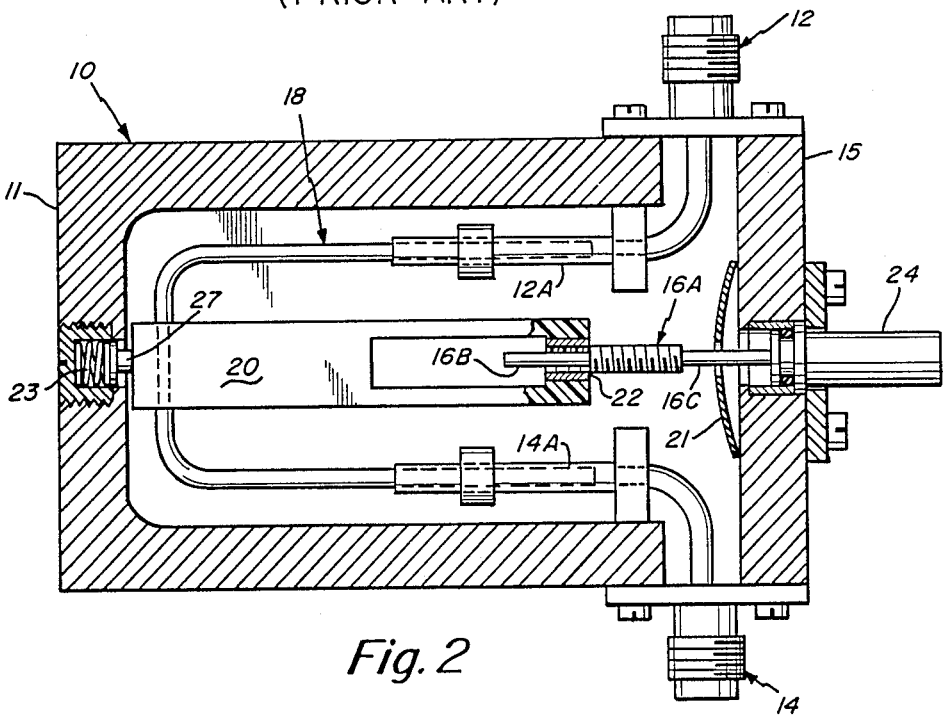
FIG. 2 is a cross-sectional view of a phase-shifter as constructed in accordance with the principles of the present invention.

Now in accordance with the present invention as shown in the somewhat schematic diagram of FIG. 2, to alleviate this problem there is provided a lead screw 16A that has thread reliefs at either end as indicated in FIG. 2 at 16B and 16C. In association with the relieved lead screws 16A, there are also provided end springs including a leaf spring 21 at one end and coil spring 23 at the other end. Associated with the coil spring 23 is a re-engagement pin 27 that is adapted to abut against the left end of the slider 20.

In FIG. 2 the slider 20 is shown in its maximum phase setting with the lead screw 16A having now disengaged from the nut 22 at the particular position illustrated in FIG. 2. It is noted that the left end of the slider 20 does not contact the wall 11 but does compress the re-engagement spring 23. Thus the slider 20 is actually biased for movement in the opposite direction or namely to the right in FIG. 2.

Now, in the position of FIG. 2, which is the maximum phase setting, it is to be noted that further rotation of the shaft 24 has no effect as the threaded portion of the lead screw is disengaged from the nut 22. Now, when the lead screw 16A is now turned in the opposite direction by the shaft 24, then the slider moves in the opposite direction or to the right in FIG. 2 with the nut 22 engaging with the lead screw under the force applied by the spring 23 moving the slider 20 by firm engagement between the nut and lead screw. As the lead screw 16A is turned in this direction the slider 20 is moved to the right in FIG. 2.

Now when the slider moves toward its minimum phase setting the right-hand end of the slider 20 engages the lead spring 21 and at about the same time the lead screw 16A disengages from the nut 22 because of the thread relief 16C at the right end of the lead screw as viewed in FIG. 2.

In this minimum phase setting the spring 21A biases the nut 22 in the direction of the lead screw 16A so that if the lead screw is again turned in the opposite direction there will be engagement between the lead screw and the nut and the slider can then subsequently be moved toward the left.

In either direction of movement there is a disengagement between the lead screw and the nut at the appropriate time to prevent any jamming or bottoming out of components. From that disengaged position, further turning in the same direction has no effect upon the movement of the slider 20. It is only when it is rotated in the opposite direction that one or the other of the springs comes into play and causes a re-engagement and thus movement of the slider in the opposite direction.

In connection with the operation in the embodiment of FIG. 2, it is noted that the lead spring 21 provides for re-engagement of the lead screw and nut when it is desired to move the slider in the left direction in FIG. 2. Alternatively, the spring 23 provides for re-engagement as in the position shown in FIG. 2 between the lead screw and the nut when the slider 20 is to be moved to the right in FIG. 2.

Reference is now made to a first detailed embodiment of the present invention illustrated in FIGS. 3-6. A second embodiment of the invention as illustrated in further detail in FIGS. 7-11. Still further alternate embodiments of the inventions are described hereinafter in the cross-sectional views of FIGS. 12 and 13.

Figure 3:
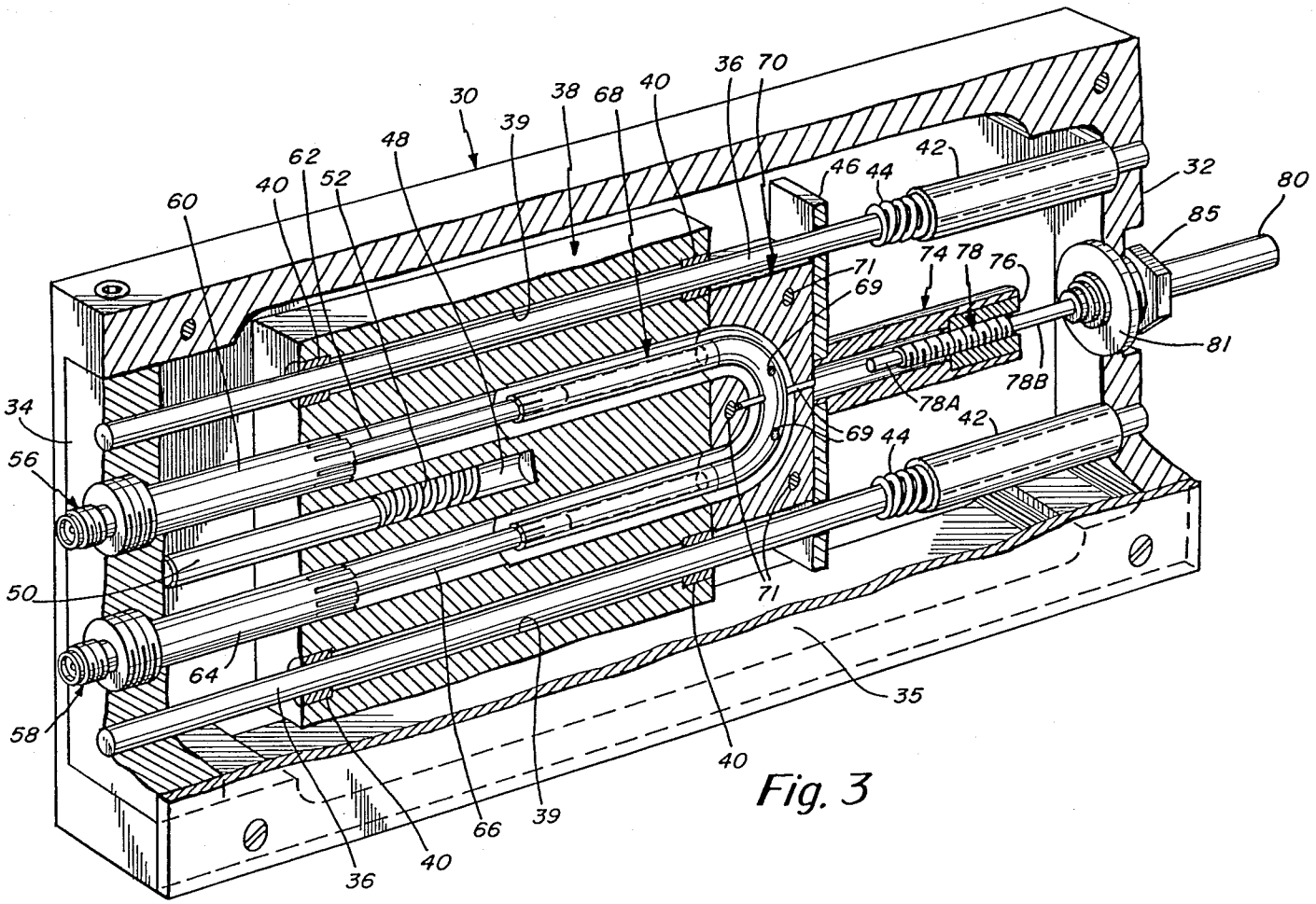
FIG. 3 is a cut-away perspective view of a first version of the invention embodying the principles illustrated in FIG. 2.

With respect to the embodiment of the invention illustrated in FIGS. 3-6, there is provided a housing 30 having a support wall 32 at one thereof and including a support plate 34 at the opposite end of the housing 30. A plate 35, as illustrated in FIG. 3 makes the housing an enclosed housing.

Figure 4:
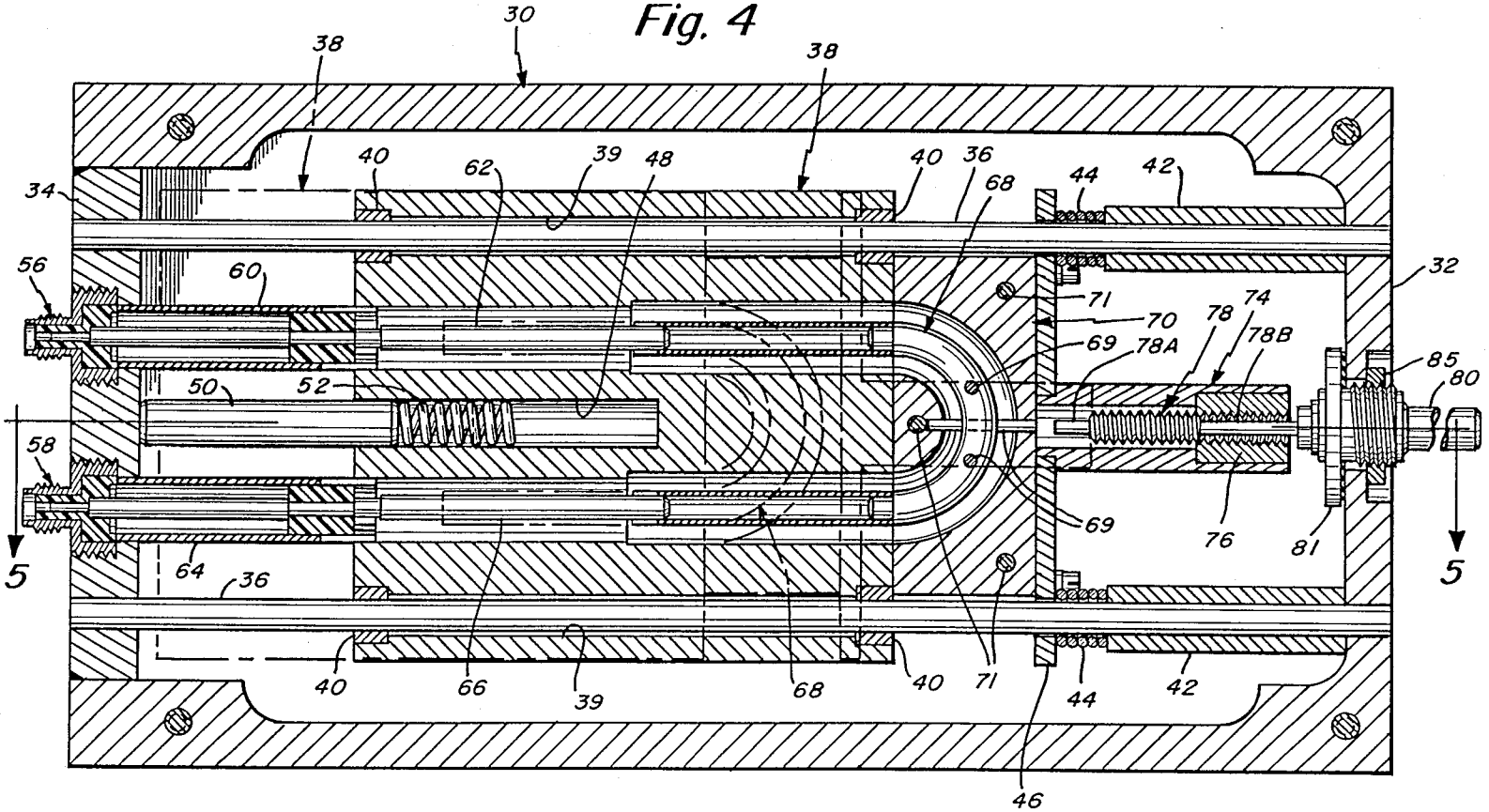
FIG. 4 is longitudinal cross-sectional view of the phase-shifter of FIG. 3 illustrated in the maximum phase setting in solid line and the minimum phase setting in phantom.

Between the walls 32 and 34 there are disposed a pair of guide rods 36 that are adapted to provide the main support for the slider 38. In this connection the slider 38 is provided with longitudinal passages 39 for receiving the respective guide rods 36. Also, as illustrated in FIGS. 3 and 4 there are provided support bushings 40. These may be oiless bronze bushings. The bushings 40 are for providing support of the slider 38 so that the slider can move longitudinally on the guide rods 36.

The guide rods 36 at their right end depicted in FIGS. 3 and 4, have disposed thereon spacers 42. The spacers 42 position the corresponding re-engagement springs 44. These re-engagement springs are coil springs as illustrated and engage with the wall 46 associated with the slider 38 as illustrated in FIG. 4.

At the left hand end of the slider 38, as depicted in FIGS. 3 and 4, there is provided a passageway 48 extending longitudinally within the slider 38. The passageway 48 accommodates a guide pin 50 and associated spring 52. In FIGS. 3 and 4 the guide pin 50 and the spring 52 are shown in their non-compressed position. Alternatively, in FIG. 5 the guide pin 50 and coil spring 52 are shown in their compressed position.

The slider 38 is the means for supporting the electrical conductors for providing the phase adjustment. In this regard there is provided a signal input connector 56 and a signal output connector 58. The signal input connector 56 couples to a fixed outer conductor 60. It also has associated therewith a fixed center conductor 62. Similarly, the signal output connector 58 connects to a fixed outer conductor 64 and a fixed center conductor 66. The center conductors 62 and 66 are fixed in position and are disposed within longitudinal passages in the moveable slider 38.

The fixed center conductors engage with a moveable center conductor 68 that is generally of U-shaped construction as illustrated in FIGS. 3 and 4. The moveable center conductor 68 may be locked to the slider 38 by means of epoxy pins as illustrated at 69.

Figure 5:
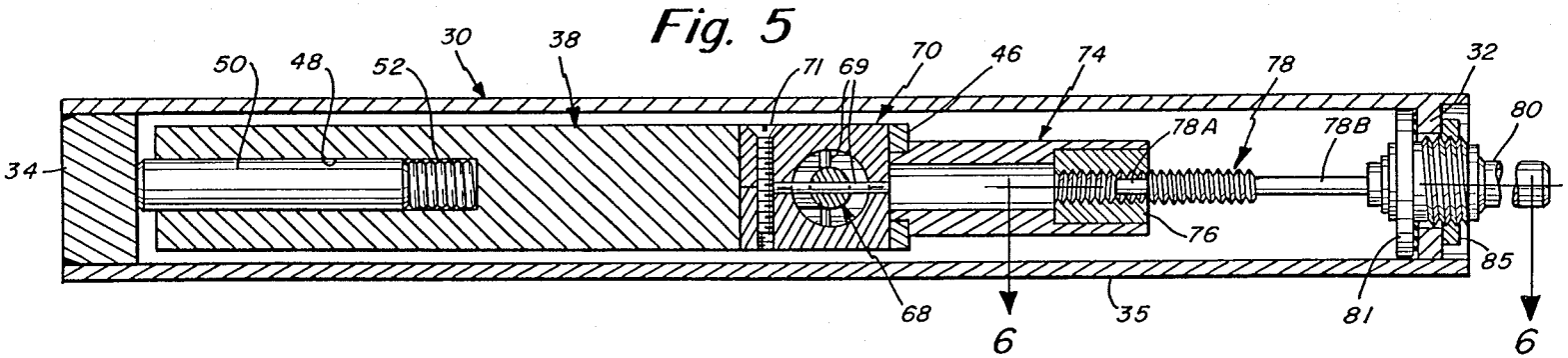
FIG. 5 is a cross-sectional view taken along line 5—5 of FIG. 4.

As illustrated in FIGS. 3–5, a portion of the slider 38 includes the member 70 which is actually provided in two halves as illustrated, in particular, in FIG. 5. These halves may be joined by means of the screws 71.

Secured to the slider 38 is the cylindrical support member 74 that is fixedly engaged with the plate 46. The support member 74 supports the nut 76 that is engaged by the lead screw 78. The slider 38 is moved longitudinally by virtue of engagement between the lead screw 78 and the nut 76. The lead screw 78 is only rotated and does not move longitudinally but when the nut 76 engages therewith the nut moves longitudinally and the slider moves therewith. Depending upon the direction of rotation of the lead screw 78, the nut can be moved in and out and thus the slider similarly can be moved between opposite positions refered to herein as maximum and minimum phase settings or positions.

Figure 6:
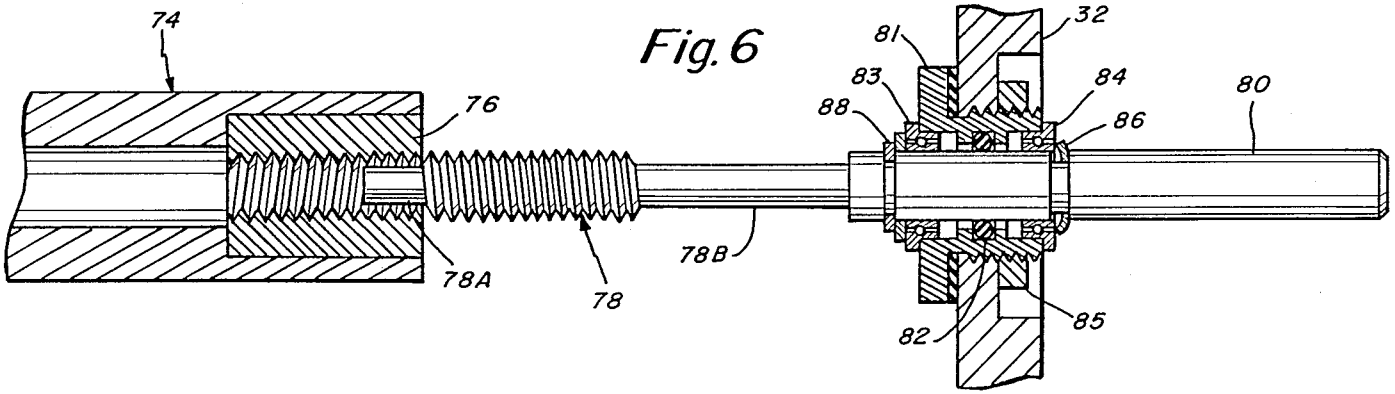
FIG. 6 is a more detailed cross-sectional view of the first version of the invention as taken along line 6—6 of FIG. 5.

The lead screw 78 is rotated by the shaft 80. For this purpose a knob or the like, not illustrated herein, may be attached to the shaft 80 for causing rotation thereof to operate the adjustment of the phase-shifter between maximum and minimum phase settings. FIG. 6 illustrates further details of the support of the shaft 80 and the lead screw 78. This support includes a member 81 that has associated therewith an O-ring 82. FIG. 6 also shows opposite bearings 83 and 84 that provide for the rotational support of the lead screw. Also illustrated in FIG. 6 is the securing nut 85, the wave washer 86 and the snap ring 88. This arrangement enables easy rotation of the shaft 80 and the corresponding lead screw 78 relative to the housing end wall 32.

To provide the operation in accordance with the present invention, it is noted that the lead screw 78 has thread reliefs at 78A and 78B. Refer in particular to the enlarged fragmentary view of FIG. 6. This thread relief at both ends enables the lead screw and nut to be engaged only over a predetermined distance of travel as determined by the length of the screw section of the lead screw disposed between the opposite thread reliefs.

In the position of the phase-shifter depicted in FIG. 3, the phase setting is at a mid-position. It is noted that in this position neither the springs 44 nor the spring 52 are compressed. It is furthermore noted that the lead screw is at an intermediate engaged position with the nut 76.

In FIG. 4 the slider 38 is shown in solid outline in its maximum phase setting with the slider 38 fully to its righthand position. It is noted that in this position the lead screw 78 has disengaged from the nut 76. Also, the springs 44 are in full compression or at least some partial compression. When moving toward this maximum phase position by rotation of the shaft 80, the position of FIG. 4 is reached and further rotation in the same direction has no additional effect because the lead screw simply remains in that position without any further drive in a longitudinal direction.

When the lead screw 78 is then turned in the opposite direction the springs 44 provide for a re-engaging force between the lead screw 78 and the nut 76. In this regard in FIG. 4 in dotted outline is shown the minimum phase setting of the slider 38.

With respect to the minimum phase setting reference is also made to FIG. 5. In this particular setting the spring 52 now is compressed. However, it is noted that the end of the slider is spaced from the wall 34 as illustrated in FIG. 5 and thus there is no jamming of components. Also, as noted in FIG. 5, the lead screw 78 is disengaged from the nut 76 in this position. Further rotation has no effect. However, rotation in the opposite direction of the lead screw 78 cause re-engagement by means of the force applied by the spring 52 so that the lead screw can now be moved toward a maximum phase setting. With regard to the minimum phase setting it is furthermore noted that there is illustrated the spring 52 in a somewhat phantom outline showing that it is compressed at this position for providing a biasing force on the slider to move the slider toward the right should the lead screw be rotated in the opposite direction.

Thus, in accordance with the principles of the present invention as illustrated in the embodiment of FIGS. 3–6, rotation of the lead screw in either of the directions causes a disengagement between the threads of the screw and the securing nut so as to limit the position of the slider to the two positions illustrated in solid and dotted outline in FIG. 4. Further rotation does not cause any binding or stripping of threads. Rotation in the opposite direction simply causes re-engagement by the spring means that are employed.

Figure 8:
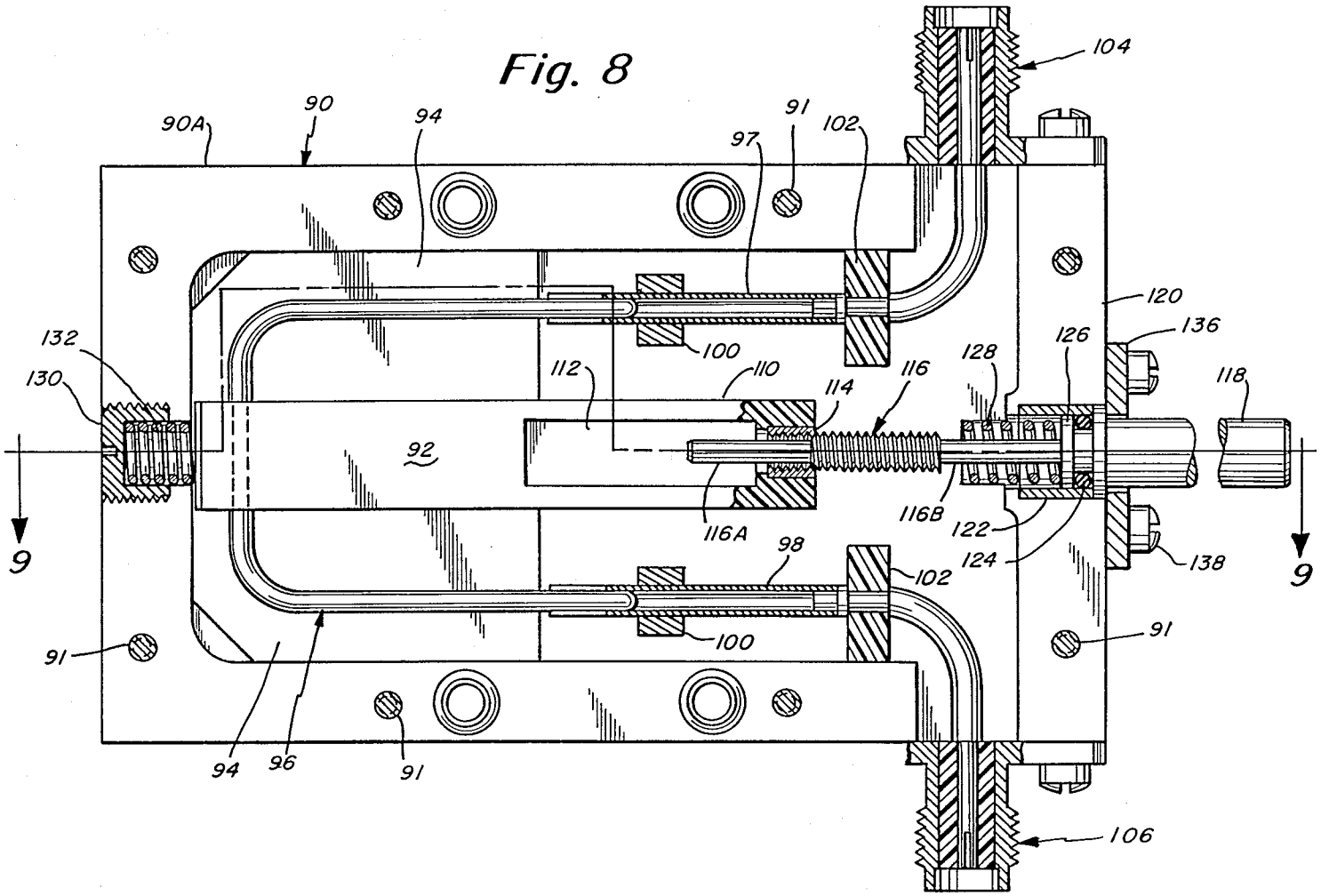
FIG. 8 is longitudinal cross-sectional view of the version of FIG. 7 at a maximum phase setting.
Figure 9:
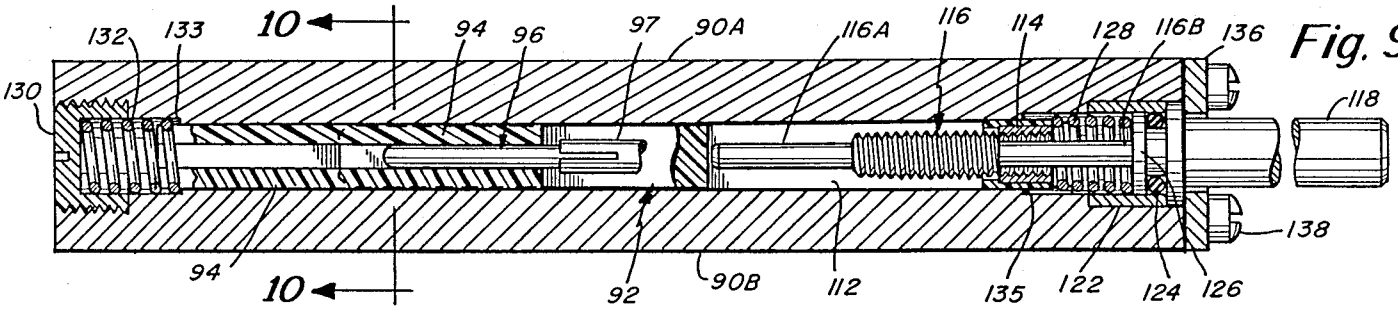
FIG. 9 is a cross-sectional view taken along line 9—9 of FIG. 8 illustrating the phase-shifter at a minimum phase setting.
Figure 10:
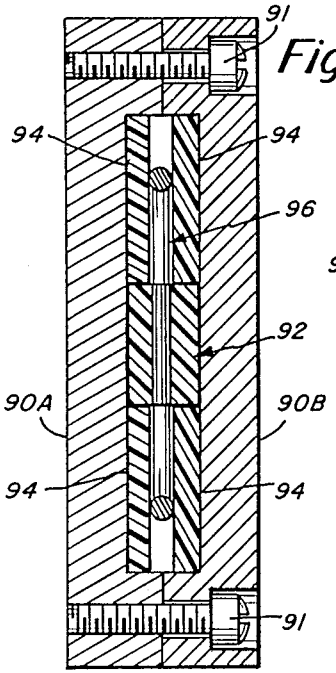
FIG. 10 is a cross-sectional view taken along line 10—10 of FIG. 9.

Reference is now made to a second embodiment of the present invention illustrated in FIGS. 7–11. This embodiment also includes a housing 90 provided in housing halves 90A and 90B. These housing halves are secured by means of bolts 91 such as illustrated in FIG. 10.

Within the housing 90 is disposed the slider 92 that is positioned within the housing by means of four plastic spacers 94. The spacers 94 provide a guiding means for the slider 92 and also provide some impedance matching for the device. In this regard also refer to the cross-sectional view of FIG. 10 that shows the four spacers 94.

Figure 7:
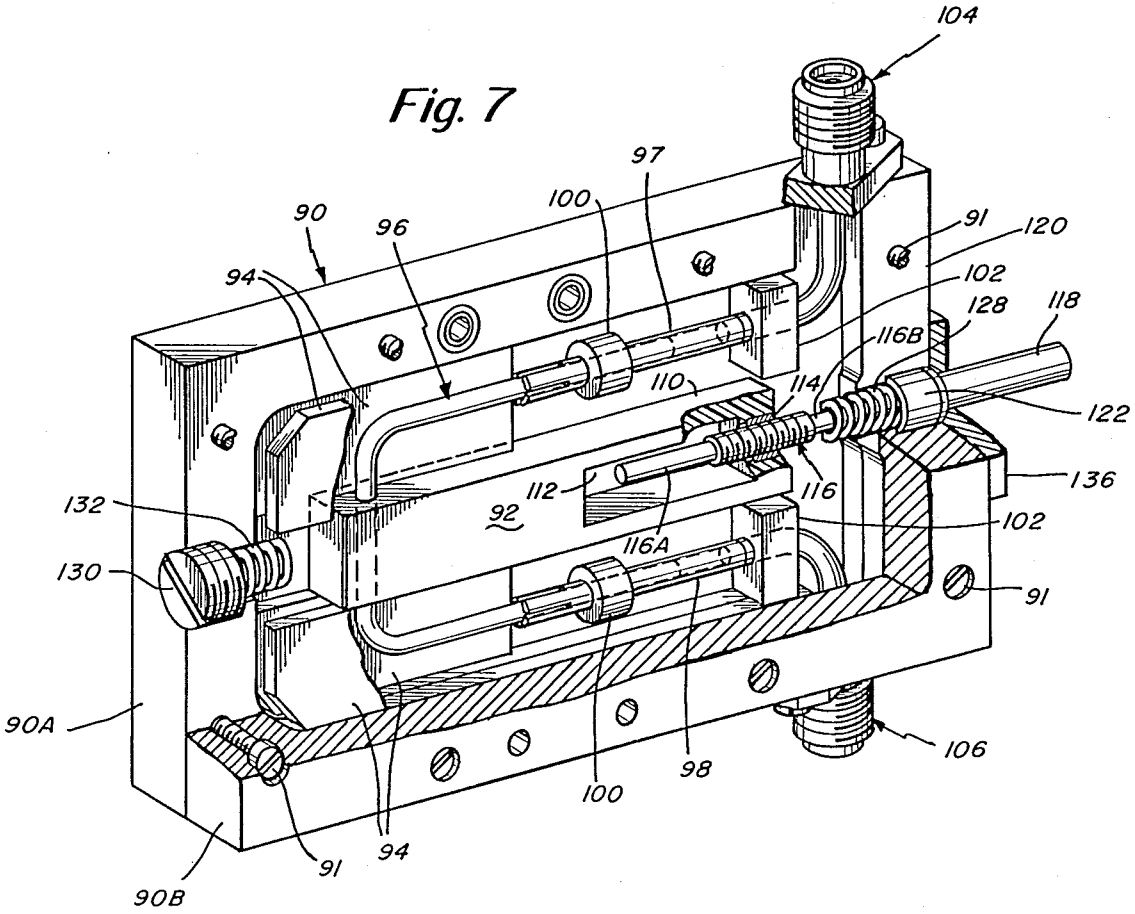
FIG. 7 is a cut-away perspective view of a second version of the present invention embodying the principles shown in FIG. 2.

The slider 92 supports a moveable center conductor 96 that is generally of U-shaped construction. The moveable center conductor 96 is illustrated in FIGS. 7 and 8, and as noted is supported by the slider 92. The center conductor 96 engages at its free ends with the fixed conductors 97 and 98. The fixed conductors 97 and 98 may have respectfully associated therewith matching rings 100. These fixed position conductors are supported by support posts 102.

FIG. 8 in particular illustrates the signal path. Note in FIG. 8 the signal input connector 104 which electrically couples to the fixed position conductor 97. Similarly, on the other side of the housing is the signal output connector 106 which couples electrically to the fixed position conductor 98. FIG. 8 also shows the sliding arrangement between the moveable conductor 96 and the fixed position conductors 97 and 98. In the particular embodiment described in FIG. 8, the conductor 96 slides inside of the hollow conductors 97 and 98. The phase-shift is adjusted by the virtue of moving the slider 92 so as to change the signal path length from conductor 97 to conductor 98.

The slider 92 includes an end 110 that is hollow at 112. The end 110 supports a nut 114 that is to interengage with the lead screw 116. It is noted, for example, as illustrated in FIG. 11, that the cavity 112 in the slider 92 is of sufficient depth to accommodate the lead screw 116 when the slider 92 is moved to its minimum phase setting such as the setting depicted in FIG. 11.

The lead screw 116 is opperated from the shaft 118 which is supported at the end wall 120 of the housing. The support includes a sleeve insert 122 as depicted in FIG. 11. There is also provided an O-ring 124 as also depicted in FIG. 11. The shaft 118 is coupled directly to the lead screw 116. The shaft 118 may be rotated by known means such as a knob attached thereto. Rotation of the shaft 118 causes direct rotation of the lead screw 116.

Figure 11:
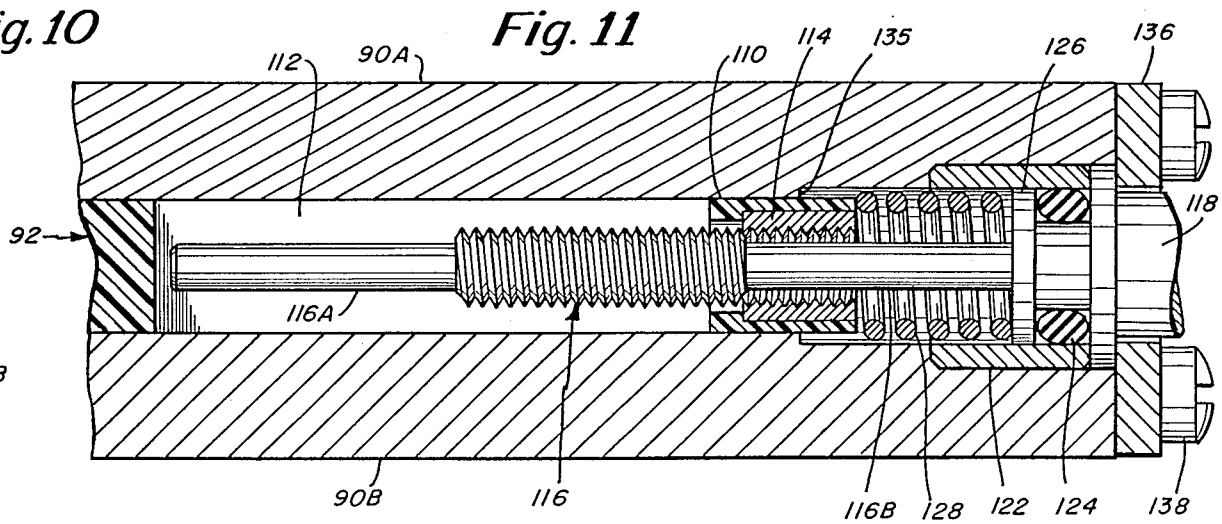
FIG. 11 is an enlarged fragmentary view of a segment of the cross-sectional view of FIG. 9.

Part of the lead screw structure includes a flange 126 such as disclosed in FIG. 11. A biasing spring 128 seats against the flange 126. The other end of this spring may engage the nut 114 particularly in the position illustrated in FIG. 11. The spring 128 is a coil spring and is adapted to bias the slider 92 in a direction toward a maximum phase setting.

The biasing of the slider 92 in the opposite direction, or toward a minimum phase setting, is accomplished by means of the threaded insert 130 and associated coil spring 132. The insert 130 is threaded, as illustrated, for example in FIG. 9 to be engaged in the end wall of the housing. The coil spring 132 is accommodated in a bore in the housing cavity with the bore being provided with a slightly larger diameter than the body cavity so that the spring is retained by the shoulder at 133 in FIG. 9.

With respect to the spring biasing arrangement it is also noted that the spring 128 is likewise retained in a bore of slightly larger diameter than the body cavity. This forms a shoulder at 135 illustrated in FIG. 11. Also note FIG. 8 wherein the position of the spring is limited by engaging against this shoulder 135.

Also illustrated in this embodiment is a shaft retainer 136. This holds the shaft in position. Bolts 138 are used for securing the shaft retainer.

FIG. 11 shows an enlarged detail of the lead screw 116. It is noted that the lead screw 116, as in the previous embodiment, has thread reliefs 116A and 116B. The thread reliefs on the lead screw, define a predetermined length of lead screw and provide the non-jamming operation of the present inventive concepts.

With regard to the embodiment of the invention illustrated in FIGS. 7–11, it is noted that in FIG. 7, in particular, the device is shown in its mid-phase position. Note in FIG. 7 that the lead screw 116 is engaged at about the middle of the nut 114. In this instance also note that both of the springs 128 and 132 are not in biased positions.

In the position illustrated in FIG. 8, the slider 92 is at its maximum phase setting. Note that the conductor 196 is at its more withdrawn position, out of the conductors 97 and 98. However, the slider 92 is not bottomed against the housing. Note the space in FIG. 8. In this position it is noted that the lead screw 116 has been turned so that it no longer engages with the nut 114. In that position the spring 132 provided a biasing force against the slider 92. When the lead screw 116 is then turned in the opposite direction this biasing force by the spring 132 causes a re-engagement between the lead screw 116 and the nut 114 so that the slider 92 can then proceed in the opposite direction or in other words in the direction towards a minimum phase setting.

With regard to the minimum phase setting, reference is now made to FIGS. 9–11. This illustrates the minimum phase setting in which the lead screw 116 has now been turned so that it now disengages from the nut 114 in the opposite direction. The lead screw 116 is now to the left side of the nut 114. In this position the spring 128 is compressed while the spring 132 is not compressed. The compression of the spring 128 provides a biasing force on the slider in the area of the nut 114 so that when the lead screw is now turned in the opposite direction the spring 128 urges the lead screw and nut into engagement so that the lead screw can then cause the nut and the associated slider secured thereto to move in the opposite direction or in other words toward a maximum phase setting.

Figure 12:
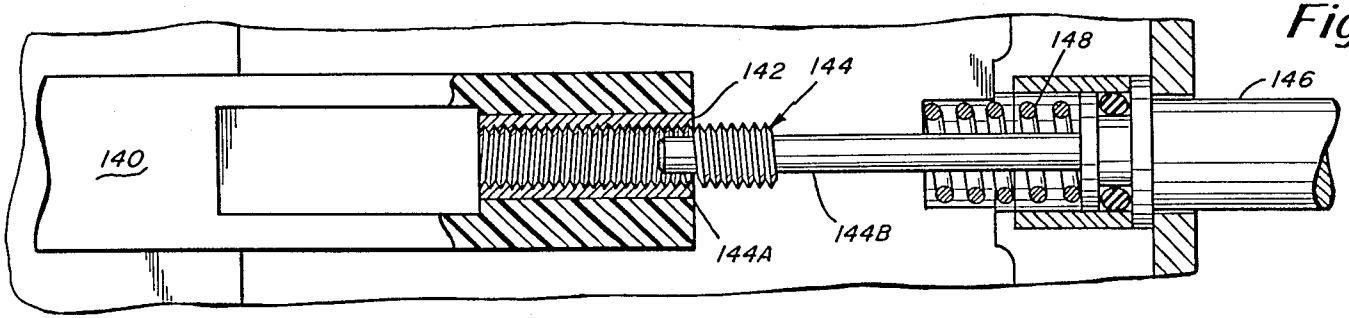
FIG. 12 is a longitudinal cross-sectional view of a further version of the present invention employing a short-length lead screw with the device in its maximum phase position.

Reference is now made to FIG. 12 which is a fragmentary view of an alternate embodiment of the invention. This embodiment is different than the previous embodiments primarily with respect to the fact that the lead screw is of a relatively short length and the nut associated therewith is longer. In FIG. 12 there is illustrated the slider 140 supporting the nut 142. It is noted that the nut 142 is of at least twice the length of the nuts previously described in the earlier embodiments. The nut 142 engages with a lead screw 144 which is driven from the shaft 146. FIG. 12 also illustrates the spring 148. In the particular position of FIG. 12, the device is in its maximum phase setting with the lead screw 144 previously rotated until it disengaged from nut 142. The spring 148 provides a bias force when the lead screw is in its opposite position on the other side of the nut 142. In the position of FIG. 12, this being the maximum phase setting, the spring 148 is in its non-compressed position.

As with the previous embodiments in FIG. 12 it is noted that the lead screw 144 has thread reliefs at 144A and 144B. The thread relief 144A is relatively short in this version while the thread relief 144B is much longer.

Figure 13:
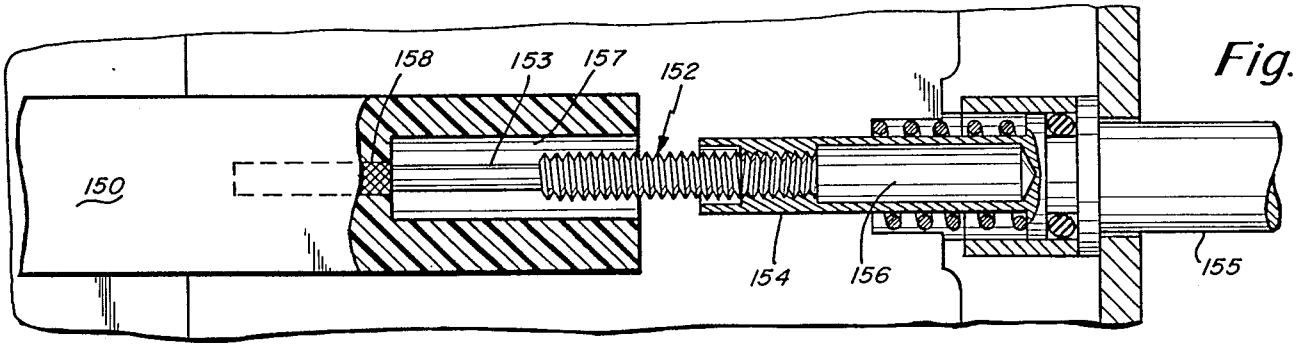
FIG. 13 is a longitudinal cross-sectional view of still a further version of the invention also in its maximum phase setting.

FIG. 13 is still a further embodiment of the present invention in which there is provided a slider 150 that supports, rather than a nut, a screw member 152 that also has a thread relief at 153. Although not illustrated in FIG. 13, the screw member 152 may also be of more elongated structure and have a thread relief at the free end thereof also. The screw member 152 engages with the rotating nut member 154. The member 154 is driven from the shaft 155. In FIG. 13 the phase-shifter is shown in its maximum phase setting. In this position the screw member 152 is disposed to the left of the nut member 154. It is furthermore noted that the nut member 154 has an elongated cavity 156 so as to accommodate the screw member 152 when the nut member 154 is rotated in the opposite direction and engages with the screw member 152. This moves the screw member and the associated slide attached thereto to the opposite position in which the slide member 150 moves to the right in FIG. 13 towards a minimum phase setting. When this occurs the nut member 154 is also capable of moving into the slide member 150 because of the large center passage in the slide member 150 at 157. The screw member 152 is preferably supported in a hole in the slide member 150. In this connection the end to the left in FIG. 13 of the screw member 152 may be knurled at 157.

Having now described a limited number of embodiments of the present invention, it is now apparent that numerous other embodiments and modifications thereof are contemplated as falling within the scope of the present invention. For example, herein either left hand or right threads can be employed. It is understood that for a particular direction, the slider will be moved in one direction or another and when the limit is reached then further rotation will not cause any movement. The oppositely disposed spring means of the present invention then permit re-engagement when the lead screw is then moved in the opposite direction until the opposite limit is reached.

What is claimed is:

1. In a phase shifter comprised of a housing, signal conductor means in the housing including fixed position signal conductor means and moveable position signal conductor means, slide means for supporting said moveable position signal conductor means, and drive means for longitudinally displacing said slide means and in turn said moveable position signal conductor means to alter phase shift, said drive means including an adjusting screw means for engagement with nut means, the improvement comprising; a thread relief at at least one end of the adjusting screw means to limit the longitudinal displacement of the slide means in both directions of translation thereof, first means for urging the slide means in one direction for re-engagement of the adjusting screw means and nut means, and second means for urging the slide means in the opposite direction for re-engagement of the adjusting screw means and nut means.

2. In a phase shifter as set forth in claim 1 wherein said adjusting screw means has a thread relief at opposite ends thereof.

3. In a phase shifter as set forth in claim 1 wherein said first means includes at least one spring.

4. In a phase shifter as set forth in claim 3 wherein said second means includes at least one spring.

5. In a phase shifter as set forth in claim 4 wherein the first and second means are disposed at opposite respective ends of the slide means.

6. A signal phase shifting apparatus comprising; a housing, signal conductor means in the housing including fixed position signal conductor means and moveable position signal conductor means, slide means for supporting said moveable position signal conductor means, and drive means for longitudinally displacing said slide means and in turn said moveable position signal conductor means to alter phase shift, said drive means including an adjusting screw means and nut means, said screw means and nut means adapted to be positioned for relative engagement therebetween, a thread relief at at least one end of the adjusting screw means to limit the longitudinal displacement of the slide means in both directions of translation thereof, first means for urging the slide means in one direction at the end of one limit of engagement between the adjusting screw means and nut means, said first means permitting re-engagement of the adjusting screw means and nut means, and second means for urging the slide means in the opposite direction upon attaining the opposite limit between the adjusting screw means and the nut means to thus permit re-engagement of the adjusting screw means and nut means.

7. A phase shifting apparatus as set forth in claim 6 wherein said adjusting screw means has a thread relief at opposite ends thereof and wherein said first and second means each include spring means.

8. A phase shifting apparatus as set forth in claim 7 wherein the spring means are disposed at opposite respective ends of the slide means.

* * * * *